US009736568B2

(12) United States Patent
Tu et al.

(10) Patent No.: US 9,736,568 B2
(45) Date of Patent: Aug. 15, 2017

(54) ELECTRONIC DEVICE, CALIBRATOR, AND HEADSET FOR CALIBRATING ELECTRONIC DEVICE

(71) Applicant: Acer Incorporated, New Taipei (TW)

(72) Inventors: Po-Jen Tu, New Taipei (TW); Jia-Ren Chang, New Taipei (TW); Ming-Chun Yu, New Taipei (TW); Kuei-Ting Tai, New Taipei (TW)

(73) Assignee: Acer Incorporated, New Taipei (TW)

( * ) Notice: Subject to any disclaimer, the term of this patent is extended or adjusted under 35 U.S.C. 154(b) by 60 days.

(21) Appl. No.: 14/693,907

(22) Filed: Apr. 23, 2015

(65) Prior Publication Data

US 2016/0066077 A1 Mar. 3, 2016

(30) Foreign Application Priority Data

Aug. 27, 2014 (TW) ..... 103129508 A

(51) Int. Cl.
*H04R 1/10* (2006.01)
*H04R 29/00* (2006.01)

(52) U.S. Cl.
CPC ..... *H04R 1/1041* (2013.01); *H04R 29/001* (2013.01); *H04R 2420/01* (2013.01)

(58) Field of Classification Search
CPC . H04R 1/1041; H04R 29/001; H04R 2420/01
See application file for complete search history.

(56) References Cited

U.S. PATENT DOCUMENTS

2008/0137896 A1* 6/2008 Tsen ..... H04R 1/1041 381/370
2009/0158849 A1* 6/2009 Gregg ..... H04R 29/00 73/584
2010/0299091 A1* 11/2010 Xia ..... H04M 1/21 702/65
2013/0148820 A1* 6/2013 Sagong ..... H04R 1/1041 381/74
2014/0064512 A1* 3/2014 Yu ..... H01R 24/58 381/74

(Continued)

FOREIGN PATENT DOCUMENTS

TW I317241 11/2009

*Primary Examiner* — Regina N Holder
(74) *Attorney, Agent, or Firm* — Jianq Chyun IP Office

(57) ABSTRACT

An electronic device, calibrator, and headset for calibrating the electronic device are provided. The headset includes an earphone, a microphone, a switch unit, and a jack, where the switch unit including a capacitor and a switch element is electrically connected between the earphone and the microphone. The switch element conducts or cuts off a first path according to a control signal of the electronic device, where the first path is a signal transmission path from the earphone, through the capacitor, and to the microphone. When the jack is inserted into a headset port of the electronic device and the switch element receives the control signal to conduct the first path, the earphone receives output signals transmitted from the electronic device, and the microphone transmits input signals back to the electronic device. The electronic device adjusts a signal to be output according to the output signals and the input signals.

5 Claims, 11 Drawing Sheets

(56) References Cited

U.S. PATENT DOCUMENTS

2014/0294184 A1* 10/2014 Tu ..... H04R 29/00
381/58
2015/0281830 A1* 10/2015 Gauger, Jr. ..... H03G 3/32
381/71.6
2015/0304769 A1* 10/2015 Weijand ..... H04R 1/1041
381/123

* cited by examiner

ELECTRONIC DEVICE, CALIBRATOR, AND HEADSET FOR CALIBRATING ELECTRONIC DEVICE

CROSS-REFERENCE TO RELATED APPLICATION

This application claims the priority benefit of Taiwan application serial no. 103129508, filed on Aug. 27, 2014. The entirety of the above-mentioned patent application is hereby incorporated by reference herein and made a part of this specification.

BACKGROUND OF THE INVENTION

1. Field of the Invention

The invention generally relates to an electronic device, a calibrator, and a headset, in particular, to an electronic device, a calibrator and a headset for calibrating the electronic device.

2. Description of Related Art

An electronic device such as a handheld mobile device, a personal computer, an all-in-one personal computer mostly provides a sound-playing feature. The consumer may listen to the music after connecting an acoustic device such as an earphone or an external speaker to the electronic device. Moreover, the consumer may also connect a microphone device to the electronic device and start using a voice input feature such as sound recording or voice chatting. With development of the technology, the size of the electronic device has become smaller and more compact, and the demand of an earphone and a microphone with their independent jacks have been gradually reduced. A headset with combined features is thus developed. Such headset may include features such as music playing, sound recording, and voice conversation, and thus provide conveniences and versatility for the consumer.

However, since a sound output behavior of each electronic device is not consistent, the audibility of the output from an earphone may not be satisfactory. For example, in terms of audiometry test software installed in an electronic device, a sound signal should be provide for a testee with accuracy. However, due to the properties of an electric signal between the electronic device and the earphone, the test result and the actual condition of the testee are not exactly matched. As another example, when the user listens to the music with an earphone from the same brand as an electronic device, its sound quality may be descent. On the other hand, when the user listens to the music with an earphone from a different brand from the electronic device, the sound quality may be unpredictable.

In terms of each existing headset available in the market, earphone circuits and microphone circuits are independent, and thus the earphone therein may be only view as an inactive component. When an electronic device plays a sound via the earphone, the properties of an electric signal between the electronic device and the earphone may not be obtained via the earphone. Each signal output by the electronic device may not be adjustable for different earphones.

SUMMARY OF THE INVENTION

Accordingly, the present invention is directed to an electronic device, a calibrator, and a headset for calibrating the electronic device, where the properties of an electric signal and a sound signal between the electronic device and the earphone may be obtained via loops designed in the calibrator and the headset, and a signal output by the electronic device may be further adjusted.

The present invention is directed to an electronic device including a headset port, a storage unit, and one or more processing unit. The storage unit is configured to record a plurality of modules. The processing unit is coupled to the headset port and the storage unit and is configured to access and execute the modules recorded in the storage unit. The modules include a detecting module, a controlling module, a transceiving module, and a calibrating module. The detecting module is configured to detect whether a jack of a headset is inserted into the headset port, where the headset includes an earphone, a microphone, and a switch unit electrically connected between the earphone and the microphone. The controlling module is configured to control the switch unit to conduct or cut off a first path, where the first path is a signal transmission path between the earphone and the microphone. When the detecting module detects that the jack of the headset is inserted into the headset port and the first path is conducted by the switch unit, the transceiving module is configured to transmit a plurality of output signals to the earphone and receive a plurality of input signals transmitted back from the microphone. The calibrating module is configured to adjust a signal to be output according to the output signals and the input signals.

The present invention is directed to a headset including an earphone, a microphone, a switch unit, and a jack. The switch unit is electrically connected between the earphone and the microphone and includes a capacitor and a switch element. The switch element is configured to conduct or cut off a first path according to a control signal of an electronic device, where the first path is a signal transmission path from the earphone, through the capacitor, and to the microphone. The jack is electrically connected to the earphone and the microphone, and is configured to be inserted into a headset port of an electronic device. When the jack is inserted into the headset port and the switch element receives the control signal to conduct the first path, the earphone receives a plurality of output signals transmitted from the electronic device, and the microphone transmits a plurality of input signals back to the electronic device, where the electronic device adjusts a signal to be output according to the input signals and the output signals.

The invention is directed to another electronic device including a first port, a second port, a storage unit, and one or more processing unit. The storage unit is configured to record a plurality of modules. The processing unit is coupled to the first port, the second port, and the storage unit and is configured to access and execute the modules recorded in the storage unit. The module includes a detecting module, a transceiving module, and a calibrating module. The detecting module detects whether a first jack and a second jack of a calibrator are respectively inserted into the first port and the second port, where the calibrator further includes an analog-to-digital converter coupled between the first jack and the second jack. When the detecting module detects that the first jack and the second jack of the calibrator are respectively inserted into the first port and the second port, the transceiving module is configured to transmit a plurality of output signals to the analog-to-digital converter of the calibrator via the first port of the calibrator and to receive a plurality of input signals transmitted back via the second port. The calibrating module is configured to adjust a signal to be output according to the input signals and the output signals.

The invention is directed to a calibrator including a first jack, a second jack, an analog-to-digital converter. The first jack is configured to be inserted into a first port of an electronic device. The second jack is configured to be inserted into a second port of the electronic device. The analog-to-digital converter is coupled between the first jack and the second jack. When the first jack and the second jack are respectively inserted into the first port and the second port of the electronic device, the analog-to-digital converter receives a plurality of output signals from the electronic device via the first jack, and the second jack transmits a plurality of input signals back to the electronic device, where the electronic device adjusts a signal to be output according to the output signals and the input signals.

The invention is directed to another calibrator including an earphone port, a microphone, a first jack, a second jack, an analog-to-digital converter, and a switch. The first jack is configured to be inserted into a port of a first electronic device. The second jack is configured to be inserted into a port of a second electronic device. The analog-to-digital converter is coupled between the first jack and the second jack. The switch is coupled to the earphone port, the first jack, and the analog-to-digital converter. When the first jack and the second jack are respectively inserted into the port of the first electronic device and the port of the second electronic device, and an earphone jack of an external earphone is not inserted into the earphone port: the microphone is set to be OFF, and a switch conducts a first calibrating path, and the analog-to-digital converter receives a plurality of first output signals transmitted from the first electronic device via the first jack, and the analog-to-digital converter transmits a plurality of first input signals back to the second electronic device via the second jack, where the first calibrating path is a signal transmission path between the first jack and the analog-to-digital converter. When the first jack and the second jack are respectively inserted into the port of the first electronic device and the port of the second electronic device, and the earphone jack of the external earphone is inserted into the earphone port: the microphone is set to be ON, and the switch conducts a second calibrating path, and the external earphone receives a plurality of second output signals transmitted from the first electronic device via the first jack and the earphone jack, and the microphone transmits a plurality of second input signals back to the second electronic device via the analog-to-digital convertor and the second jack, where the second calibrating path is a signal transmission path between the first jack and the earphone port. The second electronic device generates a first calibrating relationship according to the first input signals and the first output signals and generates a second calibrating relationship according to the second input signals and the second output signals. The first electronic device obtains the first calibrating relationship and/or the second calibrating relationship so as to adjust a signal to be output accordingly.

In summary, for the electronic device, the calibrator, and the headset for calibrating the electronic device proposed in the invention, the properties of an electric signal and a sound signal between the electronic device and the earphone may be obtained via the loops designed in the calibrator and the headset. Various application software may be developed based on the properties, and the applicability of the invention may be thus increased in practical application.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
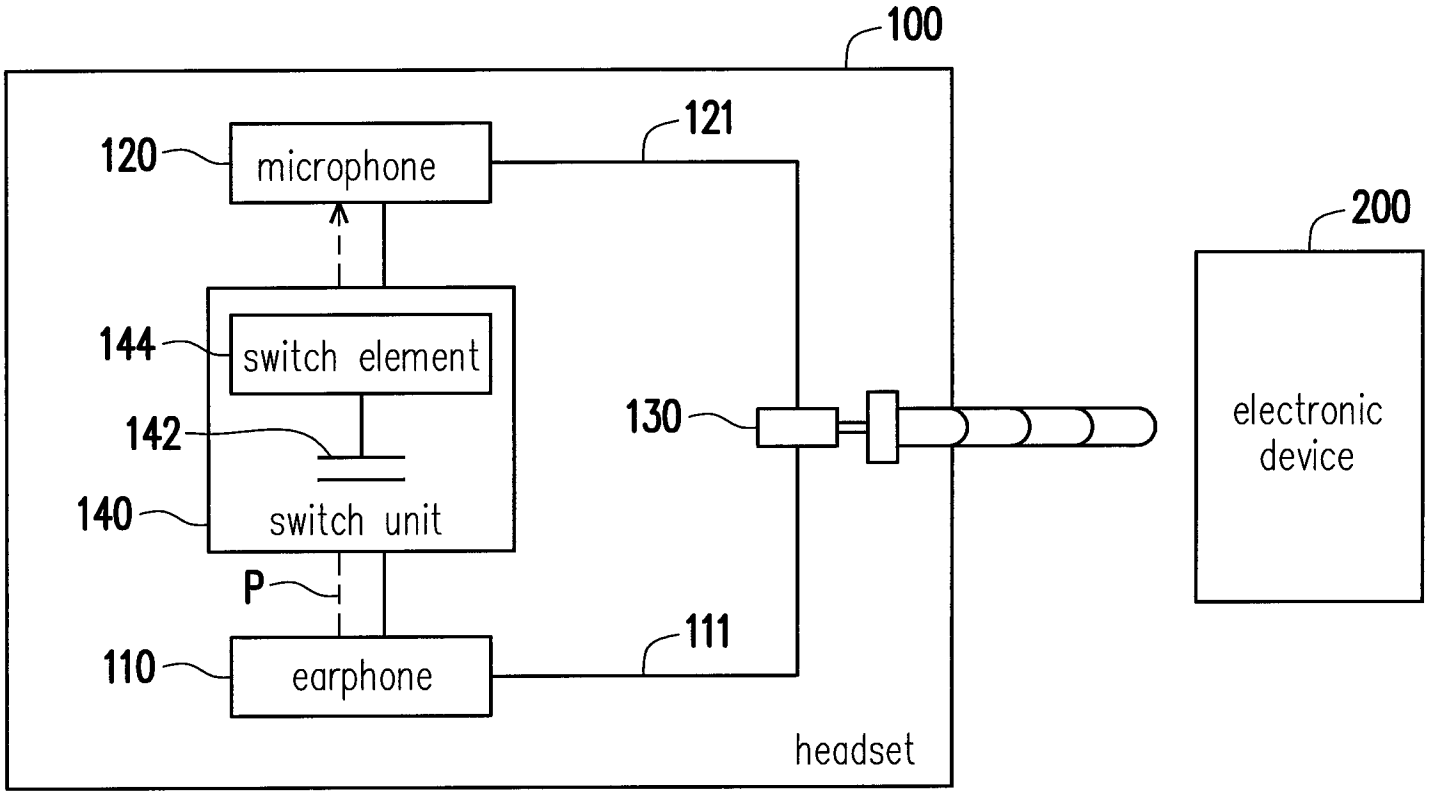
FIG. 1 illustrates a block diagram of a headset according to an embodiment of the invention.

Reference will now be made in detail to the present embodiments of the invention, examples of which are illustrated in the accompanying drawings. Wherever possible, the same reference numbers are used in the drawings and the description to refer to the same or like parts. In addition, the specifications and the like shown in the drawing figures are intended to be illustrative, and not restrictive. Therefore, specific structural and functional detail disclosed herein are not to be interpreted as limiting, but merely as a representative basis for teaching one skilled in the art to variously employ the invention.

Figure 2:
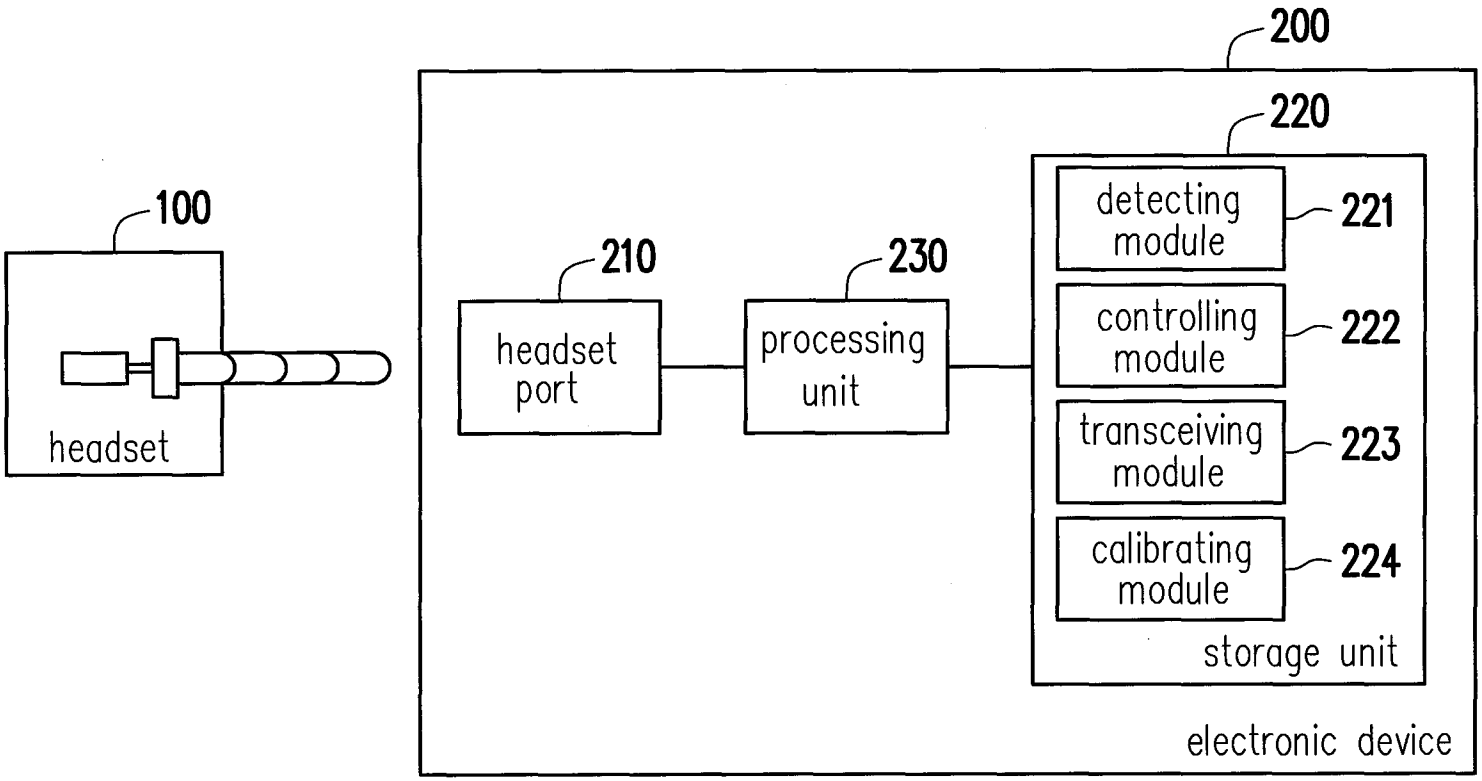
FIG. 2 illustrates a block diagram of an electronic device according to an embodiment of the invention.

FIG. 1 illustrates a block diagram of a headset according to an embodiment of the invention. FIG. 2 illustrates a block diagram of an electronic device according to an embodiment of the invention. It should, however, be noted that these are merely an illustrative example and the invention is not limited in this regard. All components of the headset as well as the electronic device and their configurations are first introduced in FIG. 1 and FIG. 2. The detailed functionalities of the components are disclosed along with FIG. 3.

Referring to FIG. 1, a headset 100 includes an earphone 110, a microphone 120, a jack 130, and a switch unit 140.

In the embodiment, the earphone 110 and the microphone 120 may be independently connected to the jack 130 via an earphone circuit 111 and a microphone circuit 121, where the jack 130 is configured to be inserted into a headset port of the electronic device 200. It should be noted that, although the earphone circuit 111 and the microphone circuit 121 are connected to the same jack 130 in the present embodiment, the earphone circuit 111 and the microphone circuit 121 may be respectively connected to two different jacks in another embodiment, where the two different plugs may be respectively inserted into an earphone port and a microphone port. The invention is not limited herein.

The switch unit 140 is electrically connected between the earphone 110 and the microphone 120 and includes a capacitor 142 and a switch element 144. When the jack 130 is inserted into the headset port of the electronic device 200, the switch element 144 is configured to conduct or cut off a signal transmission path P (referred to as "a first path" hereinafter) between the earphone 110 and the microphone 120 according to a control signal transmitted from the electronic device 200. When the switch element 144 conducts the signal transmission path between the earphone 110 and the microphone 120, alternating current signals of the earphone 110 may be blocked by the capacitor 142, and direct current signals of the earphone 110 may be transmitted to the microphone 120.

Referring to FIG. 2, the electronic device 200 includes a headset port 210, a storage unit 220, and one or more processing units 230. In the present embodiment, the electronic device 200 may be an electronic device with an audio jack such as a smart phone, a tabular computer, a personal digital assistant (PDA), a laptop computer, a desktop computer. The invention is not limited thereto.

The storage unit 220 may be one or a combination of a stationary or mobile random access memory (RAM), a read-only memory (ROM), a flash memory, a hard drive or other similar devices. The storage unit 220 is configured to record a plurality of modules executable by the processing unit 230. The modules include a detecting module 221, a controlling module 222, a transceiving module 223, and a calibrating module 224. The modules may be a computer program which is able to be loaded into the processing unit 230 for calibrating a signal transmitted from the electronic device 200 to the headset 100.

The processing unit 230 may be, for example, a central processing unit (CPU) or other programmable devices for general purpose or special purpose such as a microprocessor and a digital signal processor (DSP), a programmable controller, an application specific integrated circuit (ASIC), a programmable logic device (PLD) or other similar devices or a combination of above-mentioned devices. The processing unit 230 is coupled to the headset jack 210 and the storage unit 220, and capable of accessing and executing the modules recorded in the storage unit 220. In the present embodiment, the processing unit 230 includes a central processing unit and a sound processor including a digital signal processor and a sound codec, where the sound processor is coupled to the central processing unit and the headset port 210. However, the invention is not limited herein.

Figure 3:
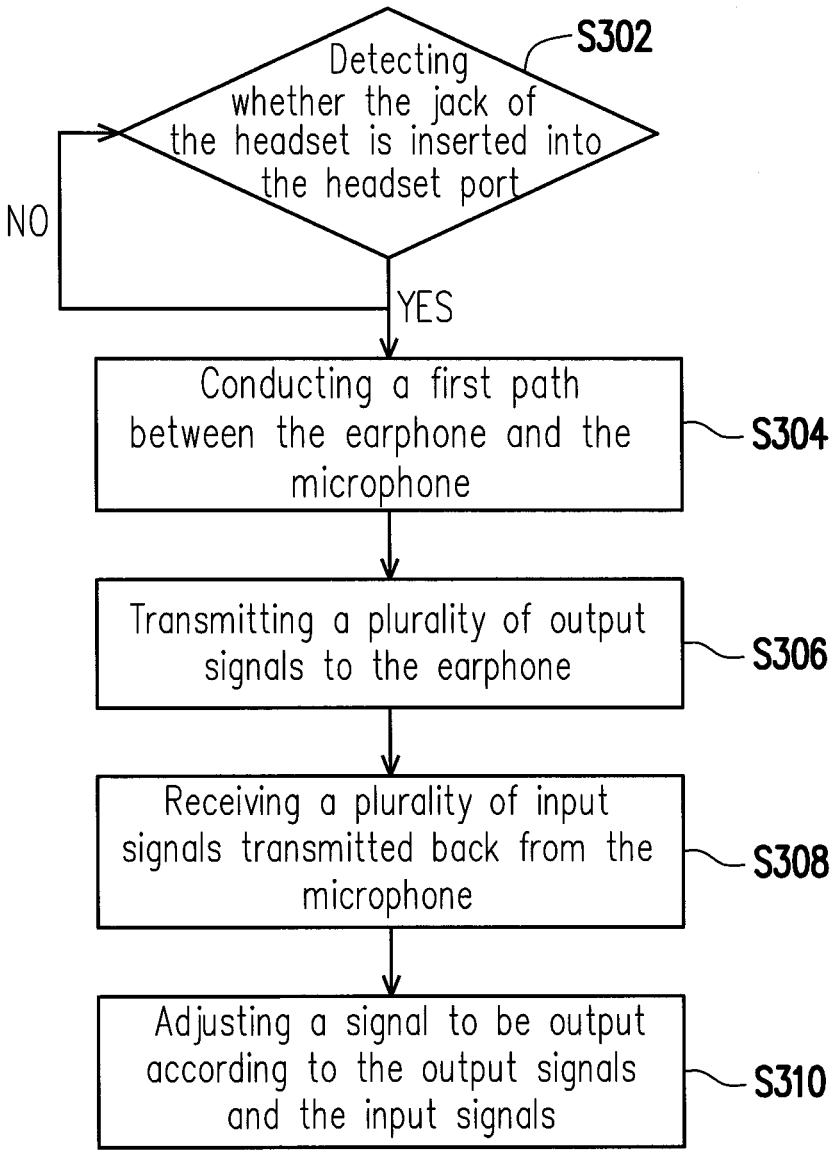
FIG. 3 illustrates a method for calibrating an electronic device according to an embodiment of the invention.

FIG. 3 illustrates a method for calibrating an electronic device according to an embodiment of the invention. Referring to FIG. 3, the method in the present embodiment is adapted to the headset 100 of FIG. 1 and the electronic device 200 of FIG. 2. Detailed steps of the aforesaid calibrating method would be illustrated along with the components of the headset 100 and the electronic device 200.

Referring to FIG. 1, FIG. 2, and FIG. 3, the detecting module 221 of the electronic device 200 detects whether the jack 130 of the headset 100 is inserted into the headset port 210 (Step S302). When the detecting module 221 detects that the jack 130 of the headset 100 is inserted into the headset port 210, the controlling module 222 controls the switch unit 140 to conduct the first path P between the earphone 110 and the microphone 120 (Step S304). To be specific, when the detecting module 221 detects that the jack 130 of the headset 100 is inserted into the headset port 210, the controlling module 222 would transmit a control signal to the switch element 144 of the switch unit 140 so as to control the switch element 144 to conduct the signal transmission path from the earphone 110, through the capacitor 142, and to the microphone 120.

Figure 4:
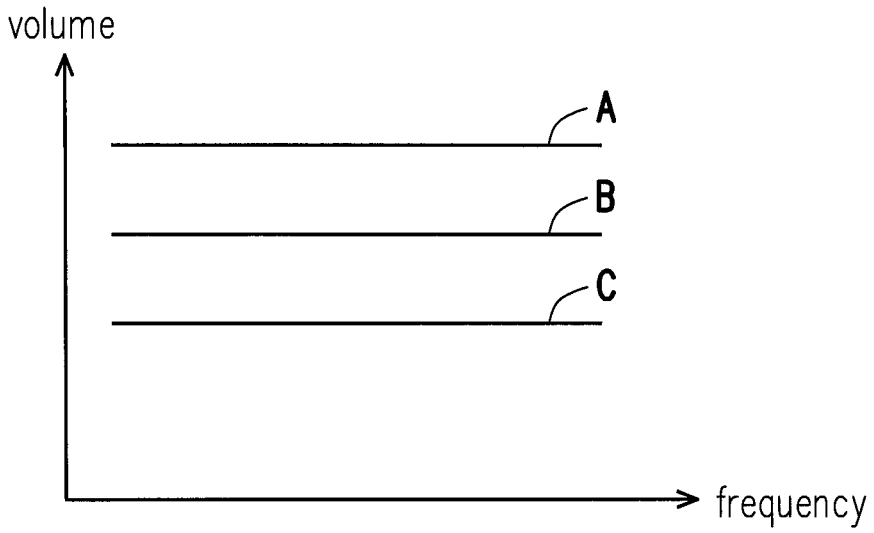
FIG. 4 illustrates swept-frequency signals with different volumes according to an embodiment of the invention.

Next, the transceiving module 223 transmits a plurality of output signals to the earphone 110 (Step S306) and receives a plurality of input signals from the microphone 120 (Step S308). To be specific, the transceiving module 223 may first transmit the output signals to the earphone 110 via the earphone circuit 111 so as to play the output signals through the earphone 110. The output signals herein may be a swept-frequency signal A, a swept-frequency signal B, and a swept-frequency signal C with different volumes as illustrated in FIG. 4. Since the switch element 144 has already conducted the first path P, the output signals may be transmitted to the microphone from the earphone 110 to the microphone 120 via the capacitor 142. Next, the microphone 120 may transmit the received output signals back to the transceiving module 223 of the electronic device via the microphone circuit 121. The signals transmitted back to the electronic device 200 via the microphone circuit 121 may be referred to as the aforesaid input signals. That is, the microphone 120 generates the input signals in response to the output signals.

Next, the calibrating module 224 of the electronic device 200 adjusts a signal to be output according to the input signals and the output signals (Step S310). Due to the properties of electric signals transmitted by the electronic device 200 and the headset 100, there exist differences between the output signals transmitted to the earphone 110 by the transceiving module 222 and the input signals received by the microphone 120. Hence, the calibrating module 224 may determine volumes, gain characteristics, dynamic ranges, and other electric signal properties according to the aforesaid differences so as to adjust the signal to be played by the earphone 110 in a follow-up step. It should be noted that, in the present embodiment, before the calibrating module 224 adjusts the signal to be output, the controlling module 222 would control the switch unit 140 to cut off the first path P between the earphone 110 and the microphone 120 so as to make the earphone 110 along with the earphone circuit 111 and the microphone 120 along with the microphone circuit 122 become independent. That is, the headset 100 would return to its normal-usage condition.

In an embodiment, the calibrating module 224 may generate a relationship (referred to as "a first relationship" hereafter) between the headset 100 and the electronic device 200 according to the output signals and the input signals, and record a model number of the headset 100 and the first relationship into the storage unit 220. Hereafter, when the electronic device 200 needs to play the signal to be output through the earphone 110, the calibrating module 224 may adjust the signal to be output according to the first relationship and transmit the adjusted signal to the earphone 110.

For example, Table 1 illustrates the output signals transmitted by the transceiving module 222 and the input signals received by the transceiving module:

TABLE 1

| | | | | | |
|---|---|---|---|---|---|
| Output signals | 0 dB | −3 dB | −6 dB | −9 dB | −12 dB |
| Input signals | 0 dB | 0 dB | 0 dB | −3 dB | −6 dB |

In the example, assume that the user desires to hear a sound with a volume of −3 dB. The calibration module 224 may adjust an output signal to −9 dB according to Table 1, and the user may thus hear a sound with an expected volume of −3 dB.

In an embodiment, since the model number of the headset 100 and the first relationship have been recorded into the storage unit 220, when the detecting module 221 detects that a jack of any headset is inserted into the headset port 210, it may detect whether a model number of the inserted headset is identical to that of the headset 100. If yes, before the electronic device 100 plays a signal to be output through the earphone 110, the calibrating module 224 may adjust the signal to be output according to the first relationship and transmit the adjusted signal to the earphone 110. If not, the electronic device 200 may execute Step S304-S310 to generate a relationship between such headset with a new model number and the electronic device 200. However, the invention is not limited herein. In other embodiments, the user of the electronic device 200 may decide whether to re-adjust the electronic device 100 even the model number of the headset 100 and the first relationship have been recorded into the storage unit 220.

From another viewpoint, when the jack 130 of the headset 100 is inserted into another electronic device, such electronic device may determine whether the model number of the headset 100 and a relationship between such electronic device and the headset 100 have been recorded. If yes, before the electronic device plays a signal to be output through the headset 110, the electronic device may first adjust the signal to be output according to the recorded relationship and then transmit the adjusted signal to the earphone 110. If no, the electronic device may generate and record the model number of the headset 100 and a new relationship between the electronic device and the headset 100 according to the calibrating method of FIG. 3.

Figure 5:
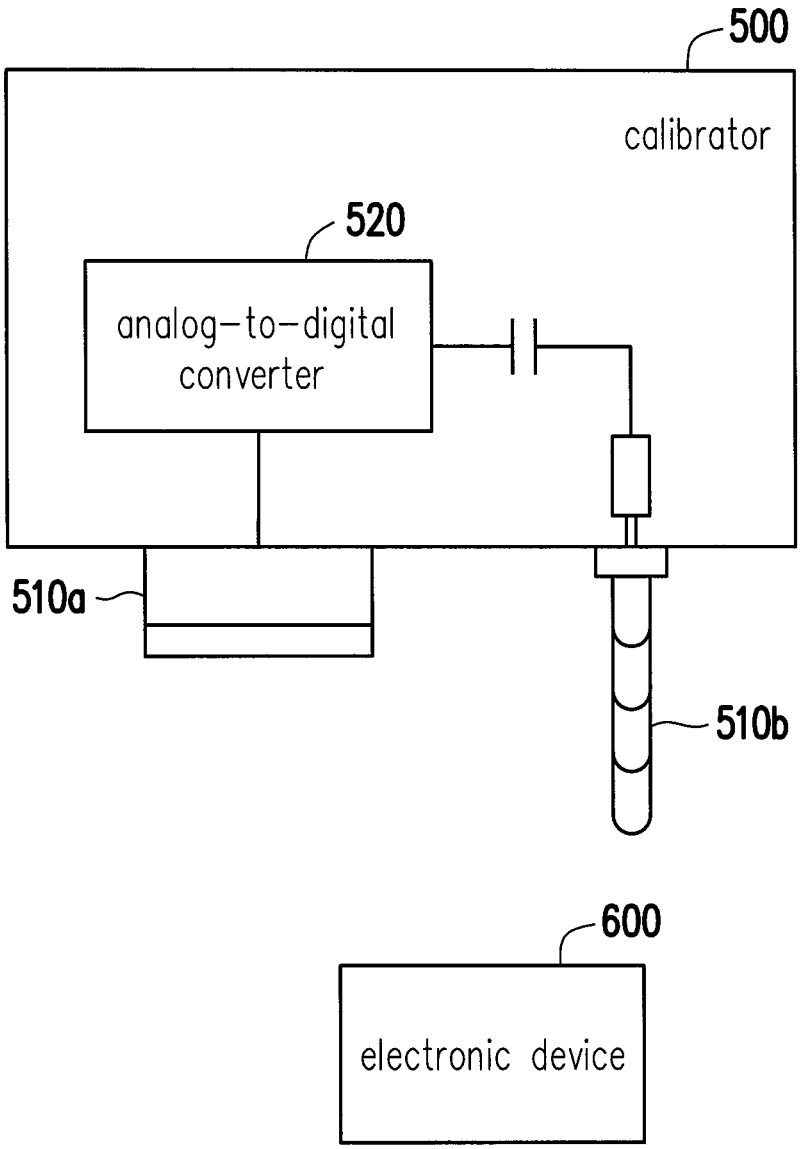
FIG. 5 is a block diagram of a calibrator according to an embodiment of the invention.
Figure 6:
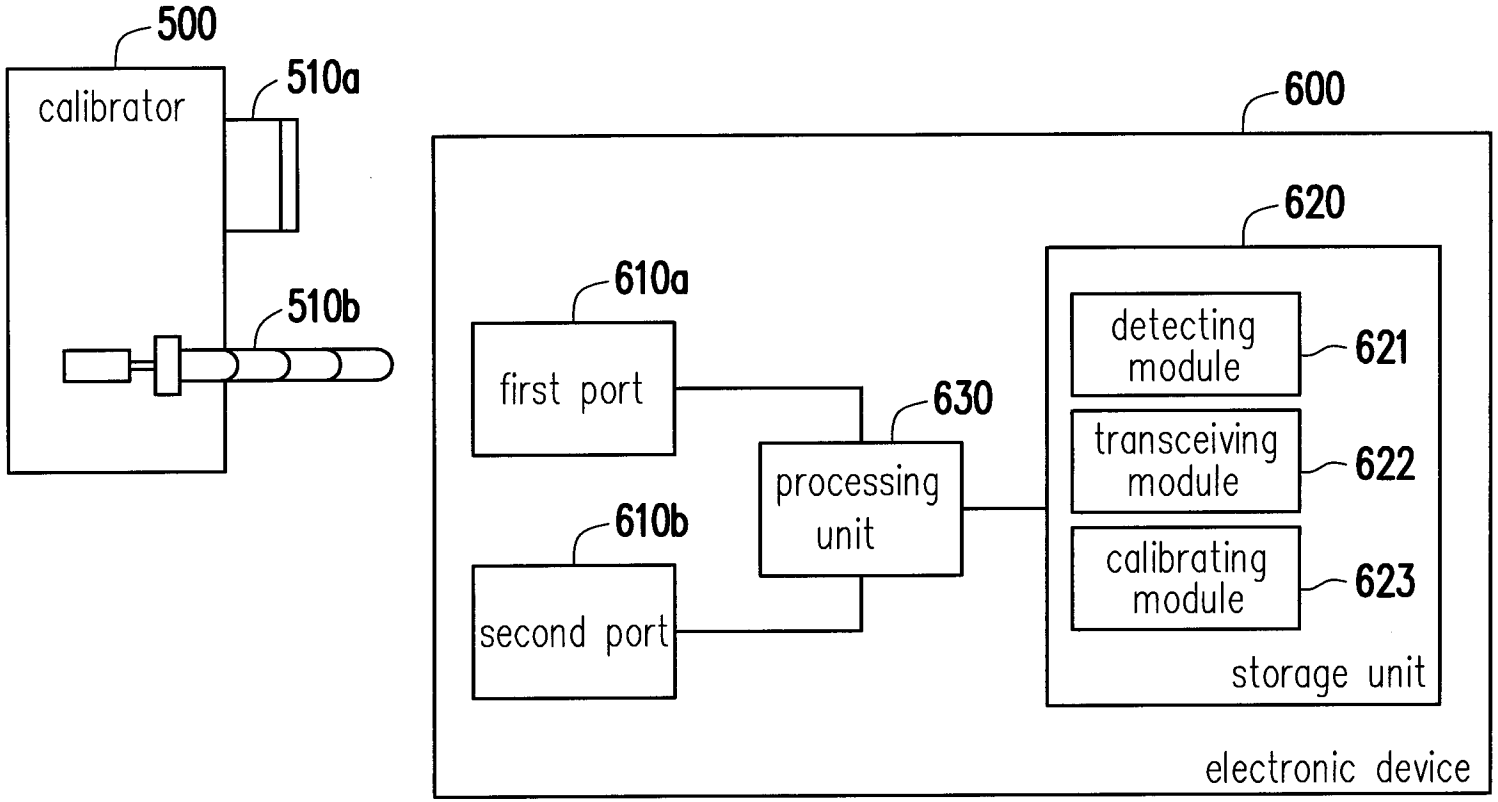
FIG. 6 is a block diagram of an electronic device according to an embodiment of the invention.

In the aforesaid electronic device and the headset for calibrating the electronic device, the switch unit is configured between the earphone and the microphone so as to form a loop. Accordingly, output signals transmitted to the earphone may be transmitted back as input signals to the electronic device through the microphone, and the properties of an electric signal as well as a sound signal may be determined according to the differences between the output signals and the input signals. In another embodiment, only the electric signal of the electronic device would be adjusted. To be specific, FIG. 5 is a block diagram of a calibrator according to an embodiment of the invention. FIG. 6 is a block diagram of an electronic device according to an embodiment of the invention.

Referring FIG. 5, the calibrator 500 includes a first jack 510*a*, a second jack 510*b*, and an analog-to-digital converter 520, where the analog-to-digital converter 520 is coupled between the first jack 510*a* and the second jack 510*b*.

The first jack 510*a* and the second jack 510*b* may be concurrently inserted into two different ports of an electronic device 600. In the present embodiment, the first jack 510*a* may be a universal series bus (USB) connector, and the second jack 510*b* may be a stereo jack. However, the invention is not limited herein. The analog-to-digital converter 520 is configured to convert a digital signal received via the first jack 510*a* to an analog signal and transmit the analog signal to the electronic device 600 via the second jack 510*b*.

Next, referring to FIG. 6, the electronic device 600 includes a first port 610*a*, a second port 610*b*, a storage unit 620, and one or more processing units 630. In the present embodiment, the electronic device 600 may be an electronic device with at least two ports such as a smart phone, a tabular computer, a PDA, a tabular computer, a desktop computer, and so forth. However, the invention is not limited herein.

The storage unit 620 may be one or a combination of a stationary or mobile RAM, a ROM, a flash memory, a hard drive or other similar devices. The storage unit 620 is configured to record a plurality of modules executable by the processing unit 630. The modules include a detecting module 621, a transceiving module 622, and a calibrating module 623. The modules may be a computer program which is able to be loaded into the processing unit 630 for calibrating a signal transmitted from the electronic device 600 to the calibrator 500.

Figure 7:
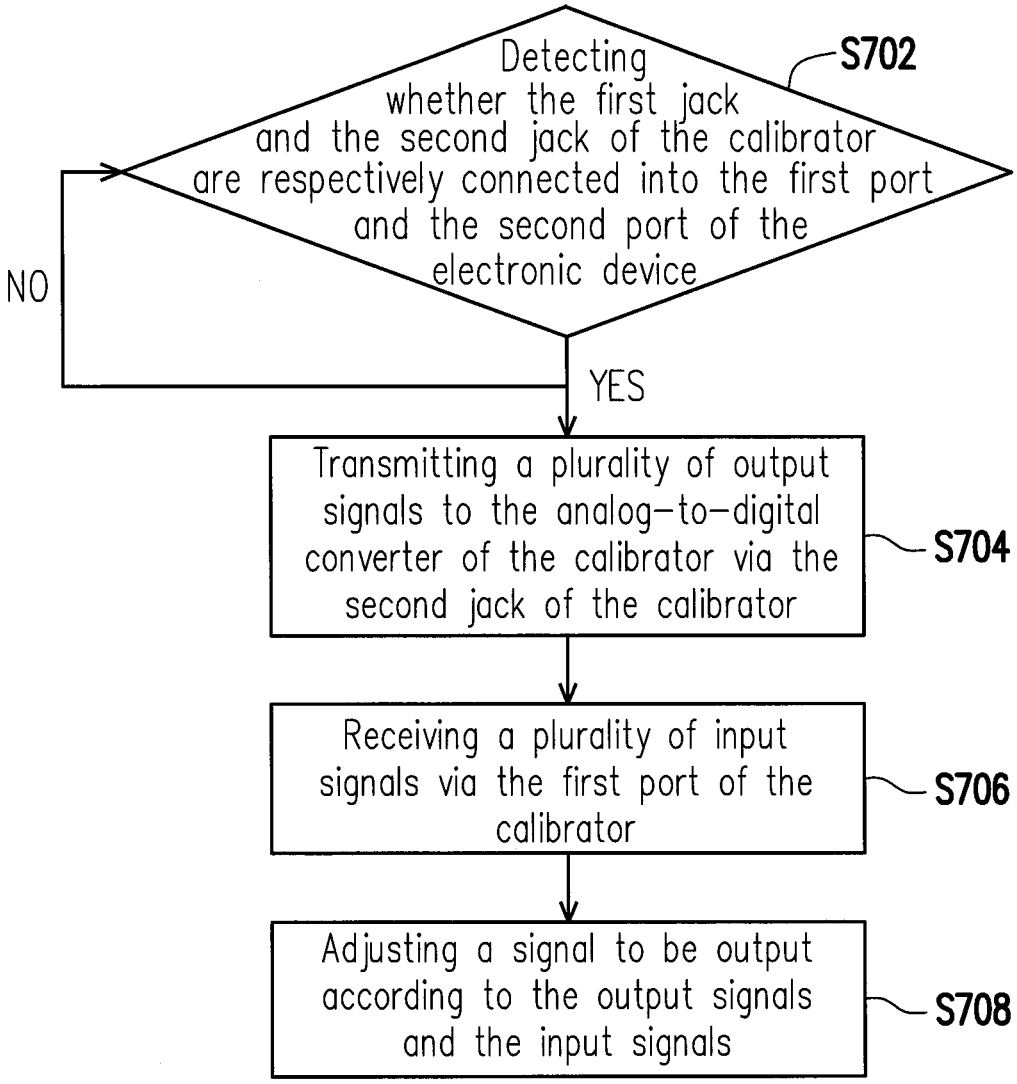
FIG. 7 is a method for calibrating an electronic device according to an embodiment of the invention.

FIG. 7 is a method for calibrating an electronic device according to an embodiment of the invention. Referring to FIG. 7, the method in the present embodiment is adapted to the calibrator 500 of FIG. 5 and the electronic device 600 of FIG. 6. Detailed steps of the aforesaid calibrating method would be illustrated along with the components of the calibrator 500 and the electronic device 600.

Referring to FIG. 5, FIG. 6, and FIG. 7, the detecting module 621 of the electronic device 600 detects whether the first jack 510*a* and the second jack 510*b* of the calibrator 500 are respectively inserted into the first port 610*a* and the second port 610*b* of the electronic device 600 (Step S702). If yes, the transceiving module 622 may transmit a plurality of output signals to the analog-to-digital converter 520 of the calibrator 500 via the first jack 510*b* of the calibrator (Step S704), and the transceiving module 622 may further receive a plurality of input signals transmitted back from the second jack 510*b* of the calibrator 500 (Step S706). If no, the detecting module 621 may continuously detect the first jack 610*a* and the second hack 610*b*. Similar to the embodiment of FIG. 3, the output signals may be, for example, the swept-frequency signal A, the swept-frequency signal B, and the swept-frequency signal C with different volumes as in FIG. 4.

Next, the calibrating module 623 of the electronic device 600 adjusts a signal to be output according to the output signals and the input signals (Step S708). To be specific, due to the properties of electric signals transmitted by the electronic device 600, there exist differences between the output signals transmitted to the calibrator 500 by the transceiving module 622 and the input signals received from the calibrator 500. Hence, the calibrating module 623 may determine volumes, gain characteristics, dynamic ranges, and other electric signal properties according to the differences so as to adjust the signal to be output by the electronic device 600 in a follow-up step.

In an embodiment, the calibrating module 623 may generate a relationship associated with the electronic device 600 (referred to as "a second relationship" hereinafter) according to the output signals and the input signals and record the second relationship into the storage unit 620. Hereafter, when the electronic device 600 needs to output the signal to be output to other devices, the calibrating module 623 may adjust the signal to be output according to the second relationship and transmit the adjusted signal to the devices. The user of the electronic device 600 may decide whether to adjust the electronic device 600 at any time.

Figure 8:
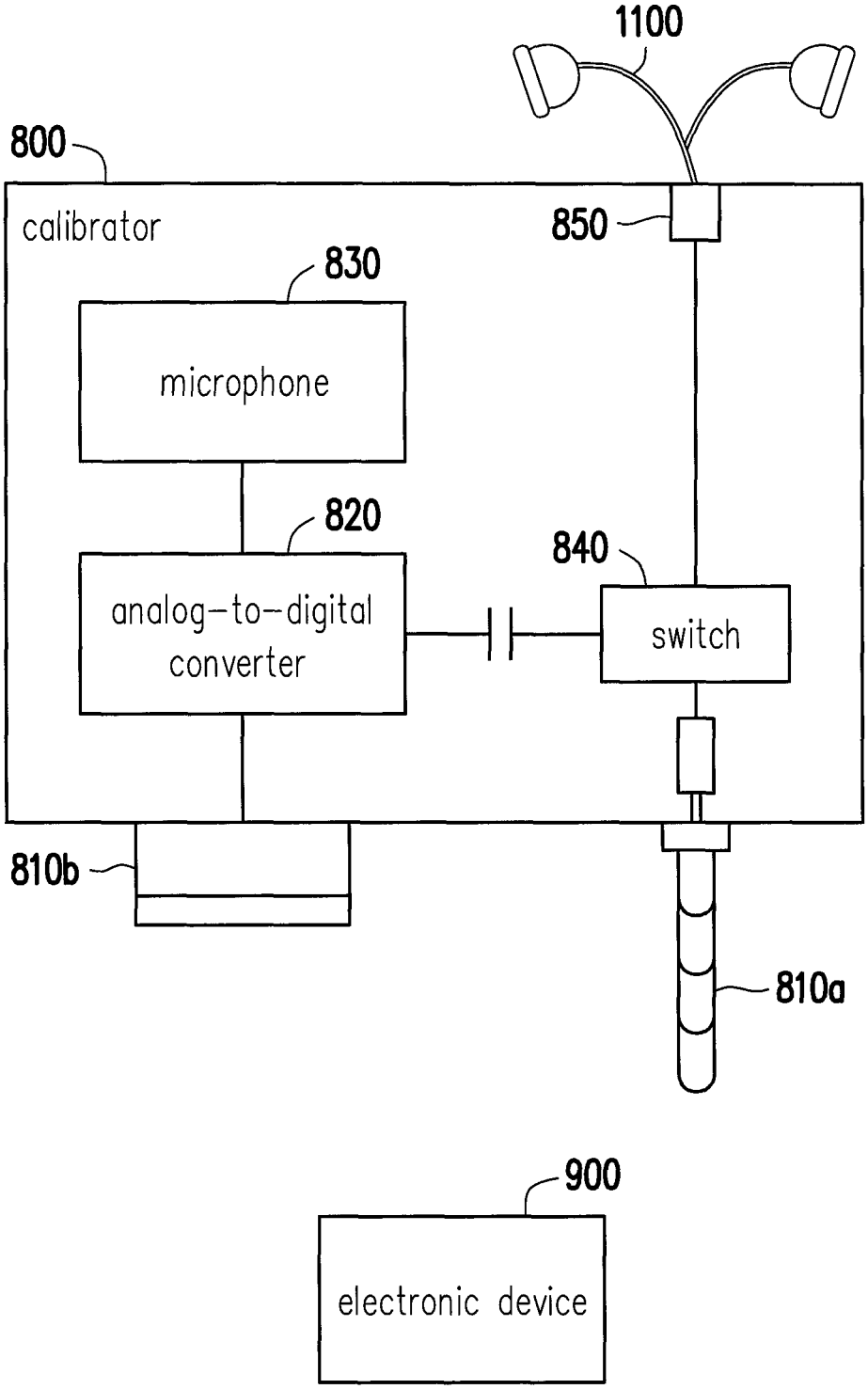
FIG. 8 is a block diagram of a calibrator according to an embodiment of the invention.
Figure 9:
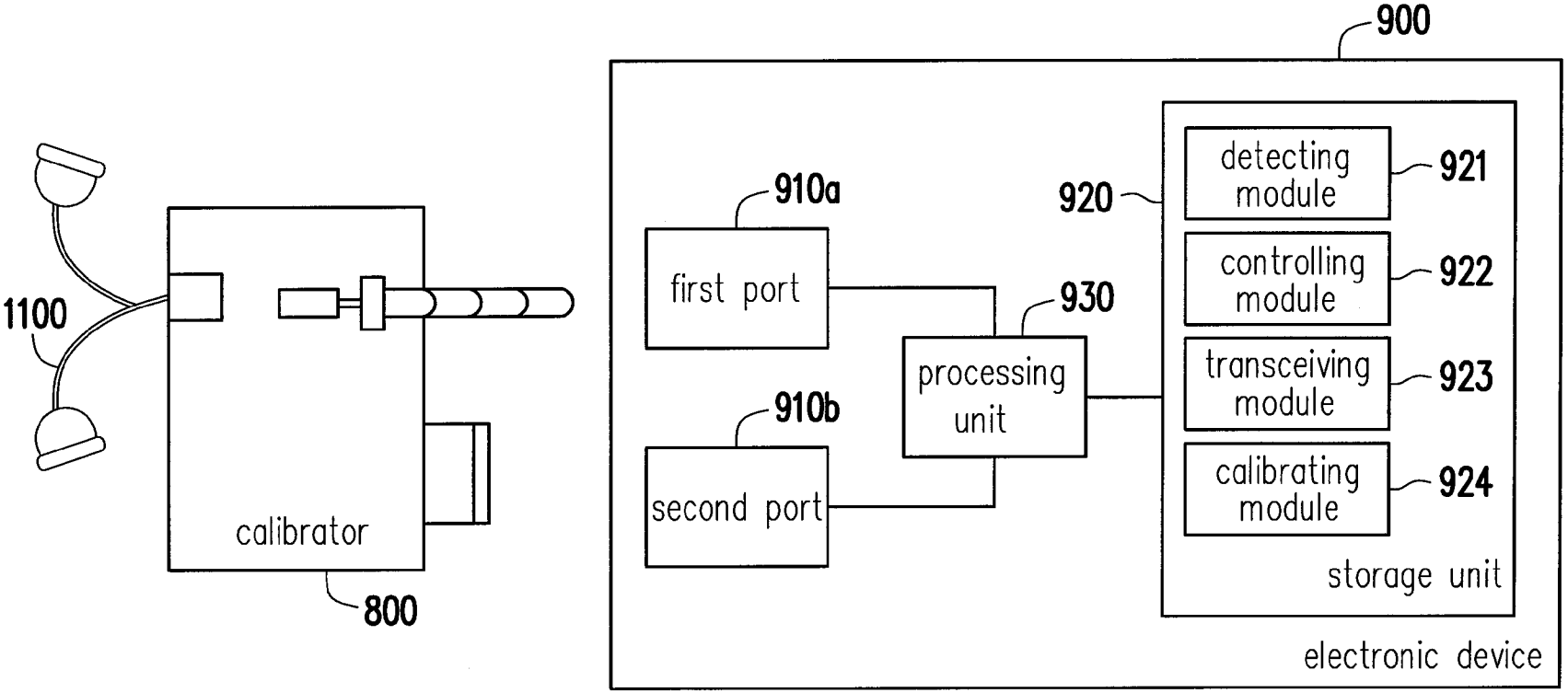
FIG. 9 is a block diagram of an electronic device according to an embodiment of the invention.

In another embodiment, when there exists an external earphone, the properties of an electric signal output by the electronic device and a sound signal output by the external earphone of the external device may be concurrently adjusted. To be specific, FIG. 8 is a block diagram of a calibrator according to an embodiment of the invention. FIG. 9 is a block diagram of an electronic device according to an embodiment of the invention.

Referring to FIG. 8, the calibrator 800 includes a first jack 810*a*, a second jack 810*b*, an analog-to-digital converter 820, a microphone 830, a switch 840, and an earphone port 850, where the analog-to-digital converter 820 is coupled to the second jack 810*b* and the microphone 830, a switch 840 is coupled to the first plug 810*a*, the analog-to-digital converter 820, and the earphone port 850.

The first jack 810*a* and the second jack 810*b* may be concurrently inserted into two different ports of an electronic device 900. In the present embodiment, the first port 810 may be a stereo jack, and the second port 810*b* may be a USB connector. However, the invention is not limited herein. The analog-to-digital converter 820 is configured to convert a digital signal received from the second port 810*b* or the microphone 830 to an analog signal and transmit the converted signal to the electronic device 900.

The switch 840 is configured to switch a signal transmission path and to set the microphone 830 to be ON or OFF according to the switched signal transmission path. The signal transmission path is determined according to whether the first jack 810*a* and the second jack 810 are concurrently inserted into the electronic device 900 and whether an earphone jack of an external earphone 1100 is inserted into the earphone port 850. Detailed description on the signal transmission path will be given later.

Next, referring to FIG. 9, the electronic device 900 includes a first port 910*a*, a second port 910*b*, a storage unit 920, and one or more processing units 930. In the present embodiment, the electronic device 900 may be an electronic device with at least two ports such as a smart phone, a tabular computer, a digital personal assistant, a tabular computer, a desktop computer, and so forth. However, the invention is not limited herein.

The storage unit 920 may be one or a combination of a stationary or mobile RAM, a ROM, a flash memory, a hard drive or other similar devices. The storage unit 620 is configured to record a plurality of modules executable by the processing unit 930. The modules include a detecting module 921, a controlling module 922, a transceiving module 923, and a calibrating module 924. The modules may be a computer program which is able to be loaded into the processing unit 930 for calibrating a signal transmitted from the electronic device 900 to the calibrator 800.

Figure 10:
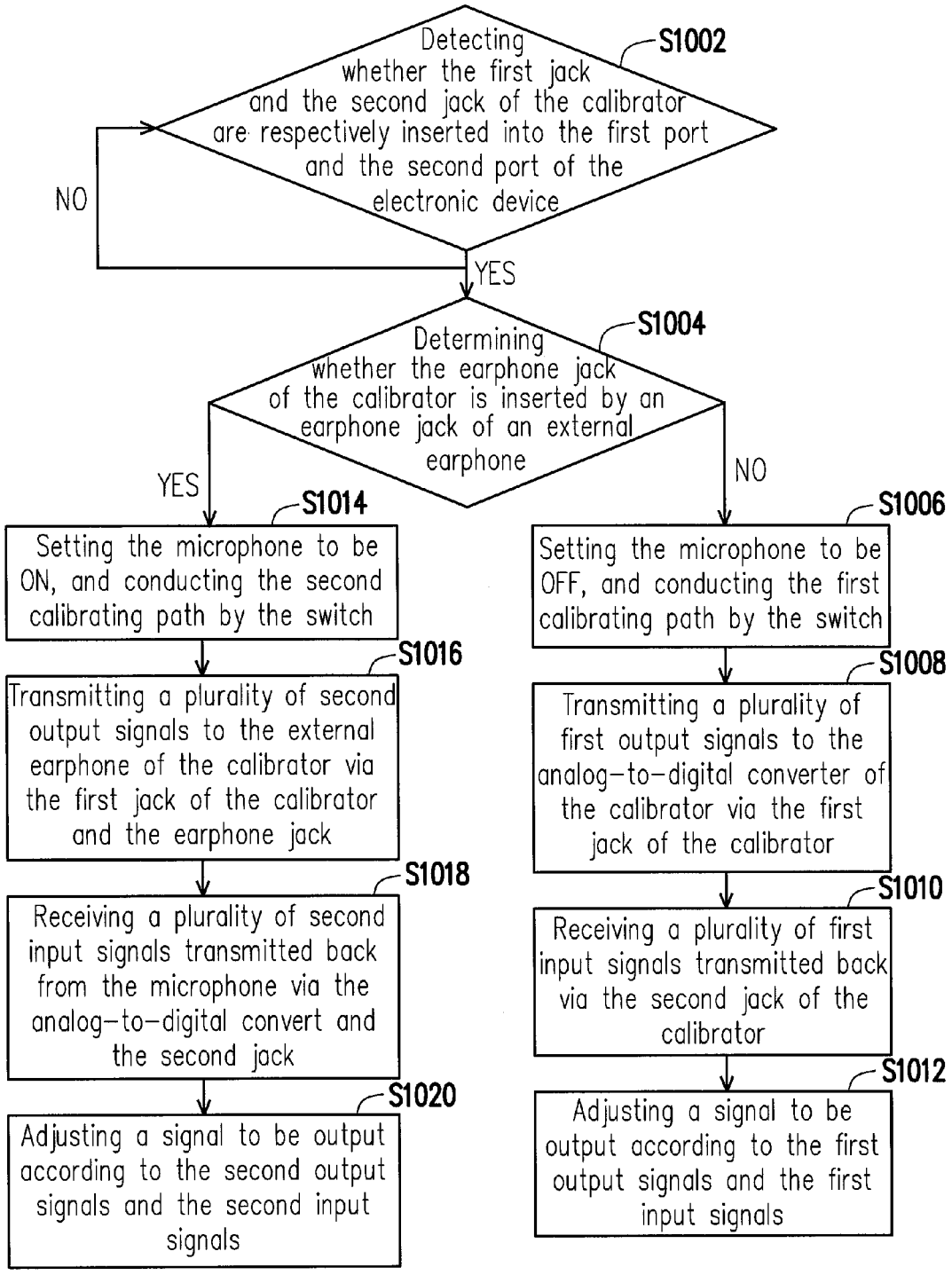
FIG. 10 is a flowchart of a method for calibrating an electronic device according to an embodiment of the invention.

FIG. 10 is a flowchart of a method for calibrating an electronic device according to an embodiment of the invention. Referring to FIG. 10, the method in the present embodiment is adapted to the calibrator 800 of FIG. 8 and the electronic device 900 of FIG. 9. Detailed steps of the aforesaid calibrating method would be illustrated along with the components of the calibrator 800 and the electronic device 900.

Referring to FIG. 8, FIG. 9, and FIG. 10, the detecting module 921 of the electronic device 900 first detects whether the first jack 810*a* and the second jack 810*b* of the calibrator 800 are respectively inserted into the first port 910*a* and the second port 910*b* of the electronic device 900 (Step S1002). If no, the detecting module 921 may continuously detect the first port 910*a* and the second port 910*b*. If yes, the detecting module 921 may further determine whether the earphone jack 850 of the calibrator 800 is inserted by the earphone jack of the external earphone 1100 (Step S1004). If no, the microphone 830 would be set to be OFF, and the switch 840 would conduct a first calibrating path (Step S1006). The first calibrating path herein is the signal transmission path between the second port 810*b* and the analog-to-digital convert 820.

In an embodiment, when the earphone jack of the external earphone 1100 is not inserted into the earphone port 850 of the calibrator 800, the calibrator 800 may send a report signal to the detecting module 921 of the electronic device 900, and the controlling module 922 may send a control signal to the calibrator 800 to set the microphone 830 to be OFF and to control the switch 840 to conduct the first calibrating path. In another embodiment, when the earphone jack of the external earphone 1100 is inserted into the earphone port 850 of the calibrator 800, the calibrator 800 may set the microphone 830 to be ON and control the switch 840 to conduct the second calibrating path through an internal controller (not shown).

When the earphone jack of the external earphone 1100 is not inserted into the earphone port 850 of the calibrator 800, the transceiving module 923 may transmit a plurality of first output signals to the analog-to-digital converter 820 of the calibrator 800 via the first jack 810*a* of the calibrator 800 (Step S1008), and the transceiving module 923 may further receive a plurality of first input signals transmitted back from the second jack 810*b* of the calibrator 800 (Step S1010). The signal transmission path in Step S1008 and Step S1010 are the same as that in Step S704 and Step S706, which is a transmission path for an electric signal of the electronic device 900. Thereafter, the calibrating module 924 may adjust the signal to be about according to the first input signals and the first output signals (Step S1012). In the present embodiment, the calibrating module 924 may generate a first relationship associated with the electronic device 900 according to the first output signals and the first input signals and record the first relationship into the storage unit 920 so as to accordingly adjust any signal to be output by the electronic device 900.

On the other hand, when the earphone jack of the external earphone 1100 is inserted into the earphone port 850 of the calibrator 800, the microphone 830 would be set to the ON status and the switch would conduct a second calibrating path (Step S1014). The second calibrating path is the signal transmission path between the first jack 810*a* and the earphone port 850. Similarly, setting the microphone 830 to the ON status and controlling the switch 840 to conduct the second calibrating path may be controlled by a control signal sent by the controlling module 922 or an internal controller of the calibrator.

Next, the transceiving module 923 transmits a plurality of second output signals to the external earphone 1100 via the first jack 810*a* and the earphone jack 850 of the calibrator (Step S1016), and the transceiving module 923 receives a plurality of second input signals transmitted back from the microphone 830 via the analog-to-digital converter 820 and the second jack 810*b* (Step S1018). In an embodiment, the first output signals may be the same as the second output signals. Next, the calibrating module 924 may adjust a signal to be output according to the second output signals and the second input signals (S1020). In the present embodiment, the calibrating module 924 may generate a second calibrating relationship between the electronic device 900 and the external earphone 1100 according to the second output signals and the second input signals, and further store the second calibrating relationship into the storage unit 920 so as to accordingly adjust any electric signal to be output by the electronic device 900 and any sound signal to be output by the external earphone 1100.

Similar to the embodiments in FIG. 3 and FIG. 7, when a new external earphone is connected to the electronic device 900, the detecting module 921 of the electronic device 900 may determine whether a model number of the new external earphone is identical to that of the external earphone 1100 so as to decide whether to adjust an output signal according to the second calibrating relationship. Moreover, the user of the electronic device 900 may decide whether to adjust the electronic device 900 and the external earphone 1100 at any time.

In an embodiment, the calibrator 800 may be connected to the electronic device 900 and another electronic device concurrently. In such way, after the another electronic device generates the first calibrating relationship and the second calibrating relationship, the electronic device 900 may obtain the aforesaid first calibrating relationship and the aforesaid second calibrating relationship via wireless connection.

Figure 11:
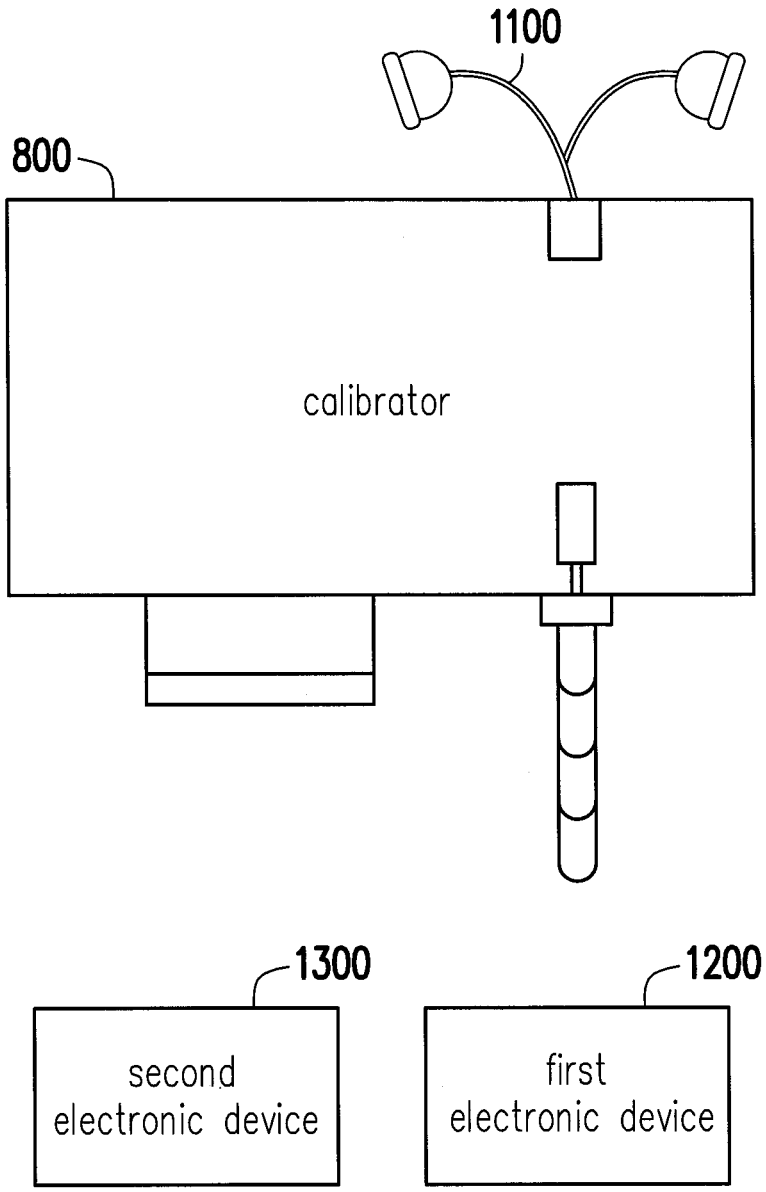
FIG. 11 is a schematic diagram of a usage scenario of the calibrator 800.

To be specific, FIG. 11 is a schematic diagram of a usage scenario of the calibrator 800.

Referring to FIG. 11, the first jack 810*a* and the second jack 810*b* may be respectively inserted into a port of a first electronic device 1200 and a port of a second electronic device 1300 in the present embodiment. The first electronic device 1200 may be, for example, a smart phone with an earphone port, and the second electronic device 1300 may be, for example, a laptop computer with a USB port. However, the invention is not limited herein.

When the first jack 810*a* and the second jack 810*b* of the calibrator are respectively inserted into the port of the electronic device 1200 and the port of the second electronic device 1300 and when the earphone jack of the external earphone 110 is not inserted into the earphone port 850 of the calibrator 800, the microphone 830 may be set to be OFF, and the switch 840 may conduct the first calibrating path. The analog-to-digital converter 820 may receive a plurality of first output signals from the first electronic device 1200 via the first jack 810*a* and transmit a plurality of second input signals back to the second electronic device 1300 via the second jack 810*b*.

On the other hand, when the first jack 810*a* and the second jack 810*b* of the calibrator 800 are respectively inserted into the port of the first electronic device 1200 and the port of the second electronic device 1300 and when the earphone jack of the external earphone 1100 is inserted into the earphone port 850 of the calibrator 800, the microphone 830 may be set to be ON, and the switch 840 may conduct a second calibrating path. The external earphone 1100 may receive the second output signals from the first electronic device 1200 via the first jack 810*a* and the earphone jack 850, and the microphone 830 may transmit the second output signals back to the second electronic device 1300 via the analog-to-digital converter 820 and the second jack 810*b*.

Next, the second electronic device 1300 may generate the first calibrating relationship according to the first input signals and the first output signals as well as the second calibrating relationship according to the second input signals and the second output signals. In an embodiment, the second electronic device 1300 may transmit the first calibrating relationship and the second calibrating relationship to the first electronic device 1200 via wireless connection. In another embodiment, the second electronic device 1300 may also upload the first calibrating relationship and the second calibrating relationship to a cloud system, and the first electronic device 1200 may download the first calibrating relationship and the second calibrating relationship from the cloud system thereafter.

In summary, for the electronic device, the calibrator, and the headset for calibrating the electronic device proposed in the invention, the properties of an electric signal and a sound signal between the electronic device and the earphone may be obtained via the loops designed in the calibrator and the headset. Various application software may be developed based on the properties, and the applicability of the invention may be thus increased in practical application.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic device comprising:

a first port;

a second port;

a storage unit, recording a plurality of modules; and one or more processing units, coupled to the first port, the second port, and the storage unit, accessing and executing the modules recorded in the storage unit, wherein the modules comprise:

a detecting module, detecting whether a first jack and a second jack of a calibrator are respectively inserted into the first port and the second port, wherein the calibrator further comprises an analog-to-digital converter coupled between the first jack and the second jack;

a transceiving module, transmitting a plurality of output signals to the analog-to-digital converter of the calibrator via the first jack of the calibrator and receiving a plurality of input signals transmitted back via the second jack of the calibrator when the detecting module detects that the first jack and the second jack of the calibrator are respectively inserted into the first port and the second port;

a calibrating module, adjusting a signal to be output according to the input signals and the output signals, wherein the detecting module further determines whether an earphone jack of an external earphone is inserted into an earphone port of the calibrator, wherein the calibrator further comprises a switch coupled between the first jack and the second jack as well as a microphone coupled to the analog-to-digital converter, wherein the earphone port is coupled to the switch, wherein the storage unit further records a controlling module that controls the microphone and the switch of the calibrator, wherein when the transceiving module detects that the first jack and the second jack of the calibrator are respectively inserted into the first port and the second port as well as determines that the earphone jack of the external earphone is not inserted into the earphone port of the calibrator, the controlling module sets the microphone of the calibrator to be OFF and controls the switch to conduct a first calibrating path, and wherein the calibrating path is a signal transmission path between the first jack and the analog-to-digital converter.

2. The electronic device of claim 1, wherein when the detecting module detects that the first jack and the second jack of the calibrator are respectively inserted into the first port and the second port as well as determines that the earphone jack of the external earphone is inserted into the earphone port of the calibrator, the controlling module sets the microphone of the calibrator to be ON and controls the switch to conduct a second calibrating path, wherein the second calibrating path is a signal transmission path between the first jack and the earphone port.

3. A calibrator comprising:

a first jack, configured to be inserted into a first port of an electronic device;

a second jack, configured to be inserted into a second port of the electronic device;

an analog-to-digital converter, coupled between the first jack and the second jack, wherein when the first jack and the second jack are respectively inserted into the first port and the second port of the electronic device, the analog-to-digital converter receives a plurality of output signals from the electronic device via the first jack and the second jack transmits a plurality of input signals back to the electronic device, and wherein the electronic device adjusts a signal to be output according to the output signals and the input signals;

an earphone port;

a microphone; and a switch, coupled to the earphone port, the first jack, and the analog-to-digital converter, wherein when the first jack and the second jack are respectively inserted into the first port and the second port, and an earphone jack of an external earphone is not inserted into the earphone port, the microphone is set to be OFF and a switch conducts a first calibrating path, wherein the first calibrating path is a signal transmission path between the first jack and the analog-to-digital converter.

4. The calibrator of claim 3, wherein when the first jack and the second jack are respectively inserted into the first port and the second port of the electronic device, and the earphone jack of the external earphone is inserted into the earphone port, the microphone is set to be ON and a switch conducts a second calibrating path, wherein the second calibrating path is a signal transmission path between the first jack and the earphone port.

5. A calibrator comprising:

an earphone port;

a microphone;

a first jack, configured to be inserted into a port of a first electronic device;

a second jack, configured to be inserted into a port of a second electronic device;

an analog-to-digital converter, coupled between the first jack and the second jack; and a switch, coupled to the earphone port, the first jack, and the analog-to-digital converter, wherein when the first jack and the second jack are respectively inserted into the port of the first electronic device and the port of the second electronic device, and an earphone jack of an external earphone is not inserted into the earphone port:

the microphone is set to be OFF, and a switch conducts a first calibrating path, and the analog-to-digital converter receives a plurality of first output signals transmitted from the first electronic device via the first jack, and the analog-to-digital convertor transmits a plurality of first input signals back to the second electronic device via the second jack, wherein the first calibrating path is a signal transmission path between the first jack and the analog-to-digital converter, wherein when the first jack and the second jack are respectively inserted into the port of the first electronic device and the port of the second electronic device, and the earphone jack of the external earphone is inserted into the earphone port:

the microphone is set to be ON, and the switch conducts a second calibrating path, and the external earphone receives a plurality of second output signals transmitted from the first electronic device via the first jack and the earphone jack, and the microphone transmits a plurality of second input signals back to the second electronic device via the analog-to-digital convertor and the second jack, wherein the second calibrating path is a signal transmission path between the first jack and the earphone port, wherein the second electronic device generates a first calibrating relationship according to the first input signals and the first output signals and generates a second calibrating relationship according to the second input signals and the second output signals, and wherein the first electronic device obtains the first calibrating relationship and/or the second calibrating relationship so as to adjust a signal to be output accordingly.

* * * * *